US012478135B2

(12) United States Patent
Ozawa et al.

(10) Patent No.: US 12,478,135 B2
(45) Date of Patent: Nov. 25, 2025

(54) SOLE AND SHOE

(71) Applicant: ASICS CORPORATION, Kobe (JP)

(72) Inventors: Keita Ozawa, Kobe (JP); Hisanori Fujita, Kobe (JP); Yousuke Atarashi, Kobe (JP); Kota Miyoshi, Kobe (JP)

(73) Assignee: ASICS CORPORATION, Kobe (JP)

( * ) Notice: Subject to any disclaimer, the term of this patent is extended or adjusted under 35 U.S.C. 154(b) by 174 days.

(21) Appl. No.: 18/046,102

(22) Filed: Oct. 12, 2022

(65) Prior Publication Data

US 2023/0123675 A1 Apr. 20, 2023

(30) Foreign Application Priority Data

Oct. 15, 2021 (JP) ..... 2021-169800

(51) Int. Cl.
*A43B 13/18* (2006.01)
*A43B 7/144* (2022.01)
*A43B 7/148* (2022.01)

(52) U.S. Cl.
CPC ..... *A43B 13/186* (2013.01); *A43B 7/144* (2013.01); *A43B 7/148* (2013.01); *A43B 13/188* (2013.01)

(58) Field of Classification Search
CPC ... A43B 13/186; A43B 13/188; A43B 13/181; A43B 13/185; A43B 13/125; A43B 13/127; A43B 7/144; A43B 7/148
See application file for complete search history.

(56) References Cited

U.S. PATENT DOCUMENTS 456,677 A * 7/1891 McIntyre ..... A43B 21/32 36/43
536,590 A * 3/1895 Tillgren ..... A43B 21/32 36/43
4,187,620 A * 2/1980 Selner ..... A43B 13/185 36/28
4,733,483 A * 3/1988 Lin ..... A43B 1/0072 36/28

(Continued)

FOREIGN PATENT DOCUMENTS

JP 2001-321201 A 11/2001
JP 3979765 B2 9/2007

OTHER PUBLICATIONS

The extended European search report issued by the European Patent Office on Feb. 14, 2023, which corresponds to European Patent Application No. 22196972.8-1015 and is related to U.S. Appl. No. 18/046,102.

(Continued)

*Primary Examiner* — Jameson D Collier
(74) *Attorney, Agent, or Firm* — Studebaker Brackett PLLC

(57) ABSTRACT

A sole includes a midsole body and a buffer member made of a material having hardness lower than that of a material constituting the midsole body. A mounting portion that mounts the buffer member is formed on a surface of a rearfoot region of the midsole body. The buffer member is mounted on the mounting portion in a non-adhesive state. One of the mounting portion and the buffer member includes a reference surface and a protrusion. The other of the mounting portion and the buffer member includes a recess. The recess includes a surrounding wall having a shape that entirely surrounds a periphery of the protrusion.

10 Claims, 21 Drawing Sheets

(56) References Cited

U.S. PATENT DOCUMENTS 4,768,295 A * 9/1988 Ito ..... A43B 13/18 36/28
4,798,010 A * 1/1989 Sugiyama ..... A43B 13/187 36/31
4,905,382 A * 3/1990 Yung-Mao ..... A43B 13/184 36/107
5,595,003 A * 1/1997 Snow ..... A43B 13/181 36/31
5,915,819 A * 6/1999 Gooding ..... A43B 19/00 36/71
6,311,414 B1 * 11/2001 Kita ..... A43B 13/026 36/35 B
6,314,664 B1 * 11/2001 Kita ..... A43B 13/12 36/31
7,707,745 B2 * 5/2010 Schindler ..... A43B 7/144 36/35 B
8,607,475 B2 * 12/2013 Nakano ..... A43B 13/181 36/38
10,750,819 B2 * 8/2020 Bunnell ..... A43C 15/16
11,882,898 B2 * 1/2024 Mason ..... A43B 13/125
11,930,882 B2 * 3/2024 Choi ..... A43B 13/127
2001/0052194 A1 12/2001 Nishiwaki et al.
2005/0160626 A1 7/2005 Townsend
2010/0218397 A1 * 9/2010 Nishiwaki ..... A43B 13/125 36/28
2010/0281712 A1 * 11/2010 Campbell ..... B29D 35/12 36/35 R
2018/0055143 A1 * 3/2018 Baucom ..... A43B 13/183
2020/0275739 A1 9/2020 Linkfield et al.

OTHER PUBLICATIONS

"Notice of Reasons for Refusal" Office Action issued in JP 2021-169800; mailed by the Japanese Patent Office on May 13, 2025.

* cited by examiner

SOLE AND SHOE

This nonprovisional application is based on Japanese Patent Application No. 2021-169800 filed on Oct. 15, 2021 with the Japan Patent Office, the entire contents of which are hereby incorporated by reference.

BACKGROUND OF THE INVENTION

Field of the Invention

The present disclosure relates to a sole and a shoe.

Description of the Background Art

Conventionally, a shoe having a structure that lessens an impact applied to a foot at the time of grounding is known. For example, Japanese Patent No. 3979765 discloses a sole that includes a midsole body including a mounting recess in a rearfoot portion and a soft buffer body mounted to the mounting recess. An upper surface of the mounting recess includes a large number of mountains and valleys arranged in a lattice shape. A lower surface of the soft buffer body includes a large number of mountains and valleys arranged in a lattice shape. Each mountain and each valley of the soft shock buffer body fit into the valley and mountain of the mounting recess. Sectional shapes of the upper surface of the midsole body and the lower surface of the soft buffer body are formed in a substantially wavy shape.

SUMMARY OF THE INVENTION

In the sole as described in Japanese Patent No. 3979765, because relatively large shearing force acts on the buffer member at the time of grounding, there is a concern that the buffer member is excessively shear-deformed with respect to the midsole body.

An object of the present disclosure is to provide a sole and a shoe capable of preventing the excessive shear deformation of the buffer member with respect to the midsole body.

A sole according to one aspect of the present disclosure is a sole constituting a part of a shoe, the sole including: a midsole body having a surface; and a buffer member made of a material having hardness lower than that of a material constituting the midsole body. The midsole body includes: a forefoot region that overlaps with a forefoot portion of a wearer of the shoe in a thickness direction of the sole; a midfoot region that overlaps with a midfoot portion of the wearer of the shoe in the thickness direction of the sole; and a rearfoot region that overlaps with a rearfoot portion of the wearer of the shoe in a thickness direction of the sole, a mounting portion that mounts the buffer member is formed on the surface of the rearfoot region, the buffer member is mounted on the mounting portion in a non-adhesive state, one of the mounting portion and the buffer member includes: a reference surface; and a protrusion that protrudes from the reference surface toward the other of the mounting portion and the buffer member, the other of the mounting portion and the buffer member includes a recess is capable of receiving the protrusion, and the recess includes a surrounding wall having a shape that entirely surrounds a periphery of the protrusion.

A shoe according to one aspect of the present disclosure includes the sole and an upper that is connected to the sole and located above the sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
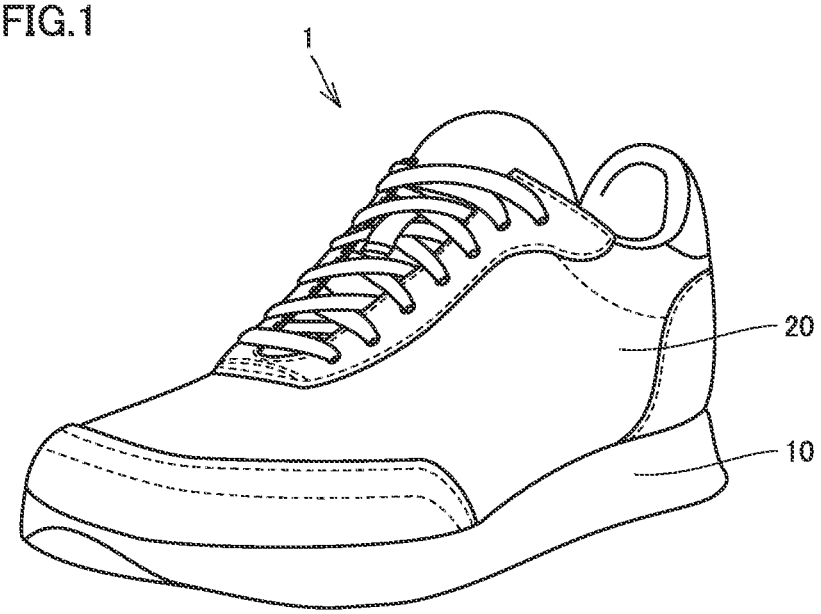
FIG. 1 is a perspective view schematically illustrating a shoe according to an embodiment of the present disclosure.

An embodiment of the present invention will be described with reference to the drawings. In the drawings referred to below, the same or corresponding member is denoted by the same reference numeral. In the following description, terms such as a longitudinal direction, a width direction, a front, and a rear are used. Terms indicating these directions indicate directions as viewed from the viewpoint of the wearer wearing a shoe 1 placed on a flat surface P (see FIG. 3) such as the ground. For example, the front refers to a toe side and the rear refers to a heel side. In addition, an inside refers to a first toe side of the foot in the width direction, and an outside refers to a fifth toe side of the foot in the width direction.

Figure 2:
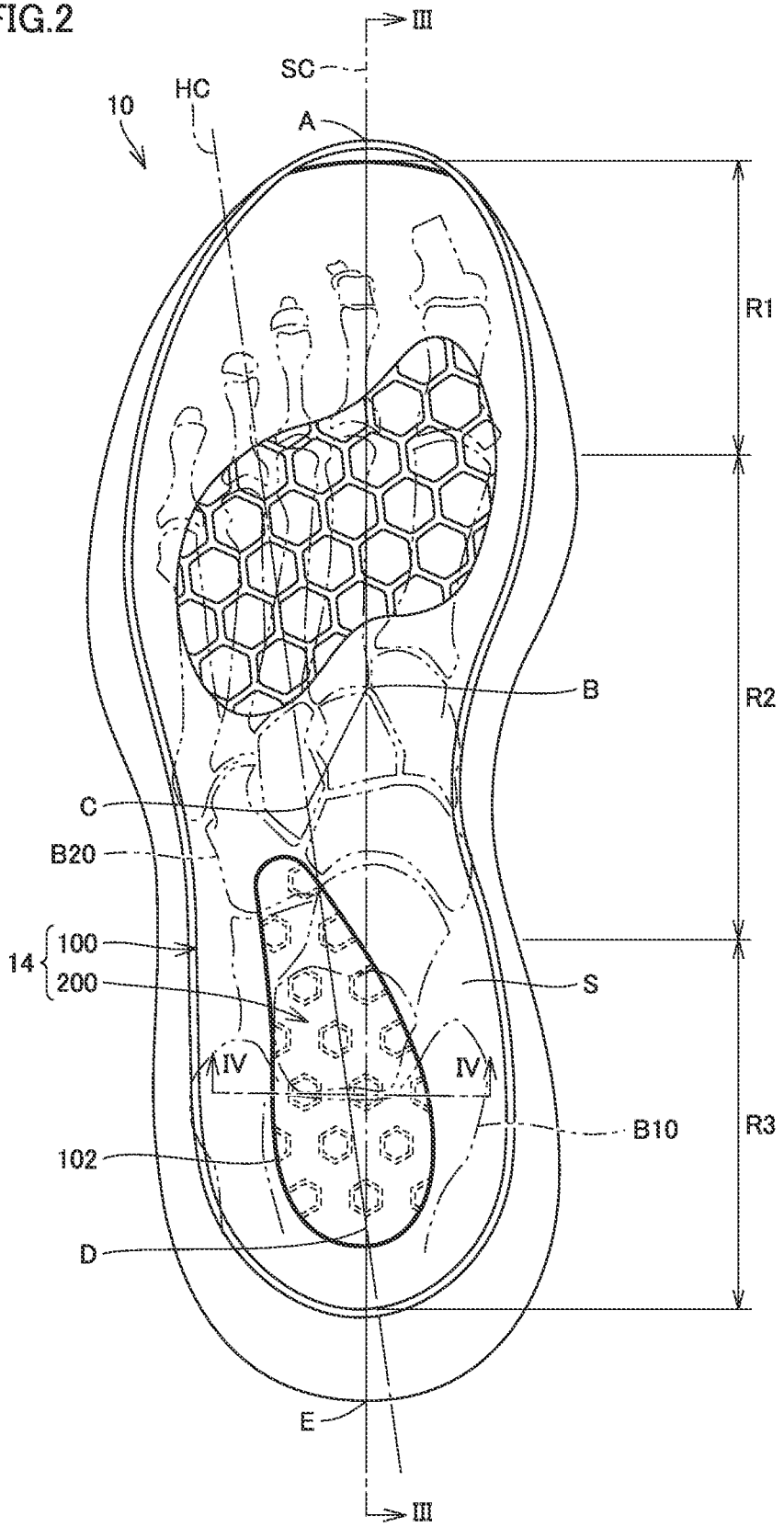
FIG. 2 is a plan view of a sole.
Figure 3:
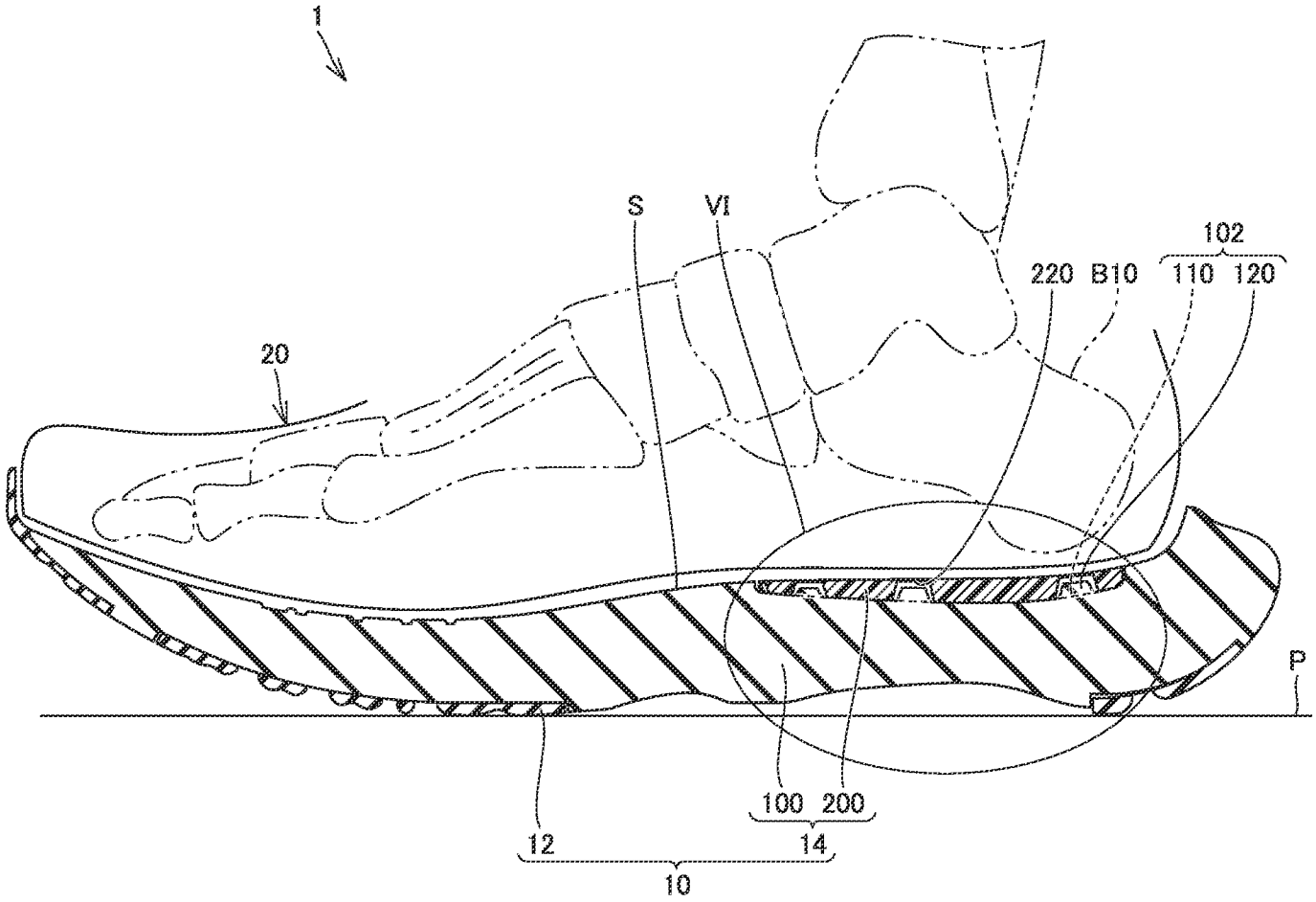
FIG. 3 is a sectional view taken along a line III-III in FIG. 2.
Figure 4:
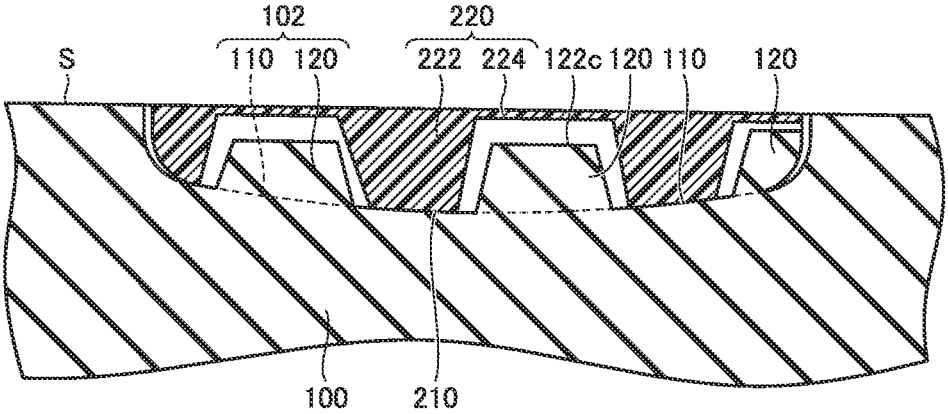
FIG. 4 is a sectional view taken along a line IV-IV in FIG. 2.

FIG. 1 is a perspective view schematically illustrating a shoe according to an embodiment of the present disclosure. FIG. 2 is a plan view of the sole. FIG. 3 is a sectional view taken along a line III-III in FIG. 2. FIG. 4 is a sectional view taken along a line IV-IV in FIG. 2. FIG. 2 illustrates a sole 10 for a left foot, but the sole 10 is also applicable to a right foot. In this case, the sole for the right foot is formed in a shape symmetrical with or substantially similar to the sole for the left foot. For example, the shoe 1 of the embodiment can be applied as sports shoes such as running or walking shoes, and the use of the shoe 1 is not limited.

As illustrated in FIGS. 1 and 3, the shoe 1 includes the sole 10 and an upper 20.

The upper 20 is connected to the sole 10 and is located above the sole 10. The upper 20 forms a space accommodating the foot of the wearer together with the sole 10. The upper 20 covers an upper surface of the foot. A middle bottom (not illustrated) may be connected to a lower portion of the upper 20. In this case, the middle base is connected to the surface of the sole 10.

The sole 10 constitutes a part of the shoe 1. The sole 10 is connected to the lower portion of the upper 20. The sole 10 includes an outer sole 12 and a midsole 14.

The outer sole 12 constitutes a grounding portion. The outer sole 12 is made of resin, rubber, or the like.

The midsole 14 is provided on the outer sole 12. The upper 20 is disposed on the midsole 14. That is, the midsole 14 is provided between the upper 20 and the outer sole 12. A lower surface of the midsole 14 is covered with the outer sole 12. Only a part of the lower surface of the midsole 14 may be covered with the outer sole 12, or an entire area of the lower surface of the midsole 14 may be covered with the outer sole 12.

The midsole 14 includes a midsole body 100 and a buffer member 200.

The midsole body 100 is provided on the outer sole 12. The midsole body 100 includes a surface S. When an intermediate bottom is provided, the intermediate bottom is disposed on the surface S. The midsole body 100 has Asker C hardness greater than or equal to 35.

For example, the midsole body 100 is formed of a resin foam material containing a resin material as a main component and a foaming agent or a crosslinking agent as an accessory component. For example, a resin foam such as a polyolefin resin, a polyurethane resin, a nylon resin, or an ethylene-vinyl acetate copolymer can be suitably used as the resin material. Alternatively, the midsole body 100 may be formed of a rubber foam material including a rubber material as the main component and a plasticizer, a foaming agent, a reinforcing agent, and a crosslinking agent as the accessory components. For example, butadiene rubber can be suitably used as the rubber material. The midsole body 100 is not limited to the above materials, but may be formed of a resin or a rubber material having appropriate strength and an excellent buffer property.

As illustrated in FIG. 2, the midsole body 100 has a forefoot region R1, a midfoot region R2, and a rearfoot region R3.

The forefoot region R1 is a region overlapping with the forefoot portion of the wearer of the shoe 1 in a thickness direction of the sole 10. The forefoot portion is a portion located in the longitudinal direction of the shoe 1 in the foot of the wearer, namely, at a front portion of a foot length direction (vertical direction in FIG. 2). The forefoot region R1 is a region located in a range of about 0% to 30% from a front end toward a rear end of the shoe 1 with respect to the entire length of the shoe 1.

The foot length direction is a direction parallel to a shoe center SC (see FIG. 2). The shoe center SC is not limited to the center line of the shoe 1, but may be a line corresponding to a straight line connecting the center of a calcaneus B10 of the standard wearer of the shoe 1 and a first toe and a second toe gap.

The midfoot region R2 is a region overlapping with a midfoot portion of the wearer of the shoe 1 in the thickness direction of the sole 10. The midfoot portion is a portion located at a central portion in the longitudinal direction of the foot of the wearer. The midfoot region R2 is a region located in the range of about 30% to 80% from a distal end toward the rear end of the shoe 1 with respect to the entire length of the shoe 1.

The rearfoot region R3 is a region overlapping with the rearfoot portion of the wearer of the shoe 1 in the thickness direction of the sole 10. The rearfoot portion is a portion located at a rear portion of the foot of the wearer in the longitudinal direction. The rearfoot region R3 is a region located in the range of 80% to 100% from the front end toward the rear end of the shoe 1 with respect to the entire length of the shoe 1.

A mounting portion 102 mounting the buffer member 200 is formed on at least the surface S of the rearfoot region R3. In the embodiment, the mounting portion 102 is formed in the range from the rearfoot region R3 to the midfoot region R2. As illustrated in FIG. 2, the rear end of the mounting portion 102 is formed at a position overlapping with a calcaneus B10 of the wearer in the thickness direction of the sole 10. The front end of the mounting portion 102 is located on a lateral foot side of a heel center HC. More specifically, the front end of the mounting portion 102 is formed at the position overlapping with a cuboid bone B20 of the wearer in the thickness direction of the sole 10. That is, the mounting portion 102 has a shape extending from the position overlapping with the calcaneus B10 of the wearer to the position overlapping with the cuboid bone B20 in the thickness direction of the sole 10. The heel center HC means a straight line connecting the center of the calcaneus B10 of the standard wearer of the shoe 1 and a third toe and a fourth toe.

FIG. 3 illustrates a section of the shoe 1 along a line segment AB, a line segment BC, a line segment CD, and a line segment DE in FIG. 2. A point A is an intersection of a shoe center SC and the front end of the sole 10. A point B is an intersection between the rear end of the second metatarsal bone and the shoe center SC. A point C is an intersection of the rear portion of a lateral cuneiform bone and the heel center HC. A point D is an intersection of the heel center HC and the shoe center SC. A point E is an intersection of the shoe center SC and the rear end of the sole 10.

Figure 5:
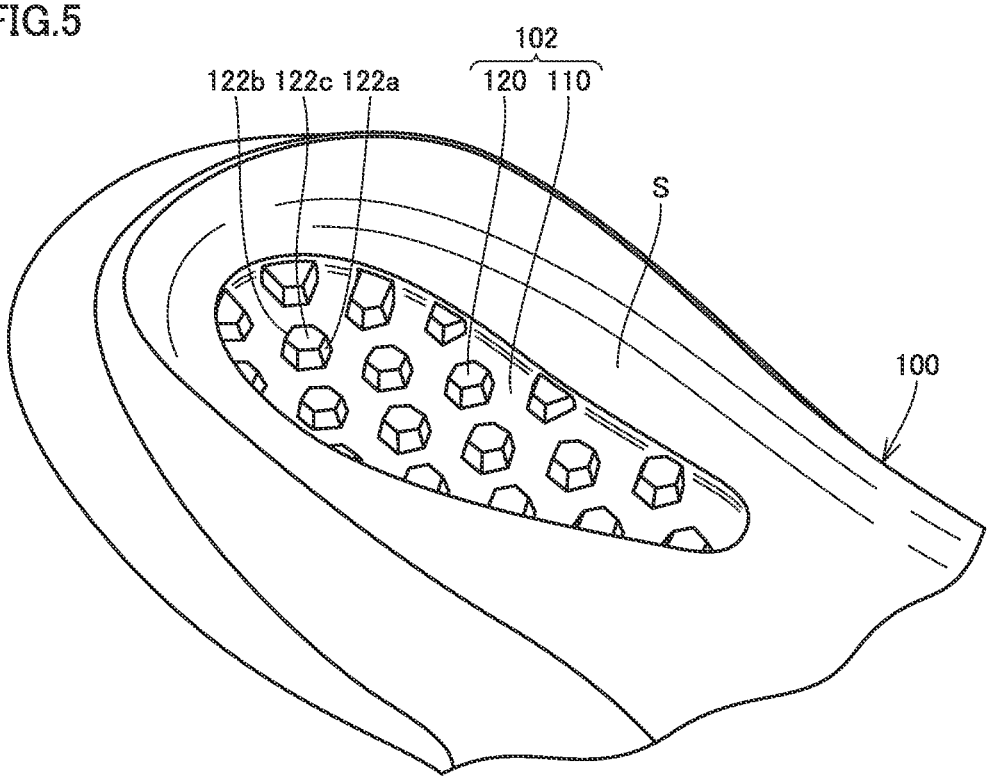
FIG. 5 is a perspective view illustrating a mounting portion of a midsole body and a vicinity thereof.

As illustrated in FIGS. 3 to 5 and the like, the mounting portion 102 includes a reference surface 110 and a protrusion 120.

Figure 6:
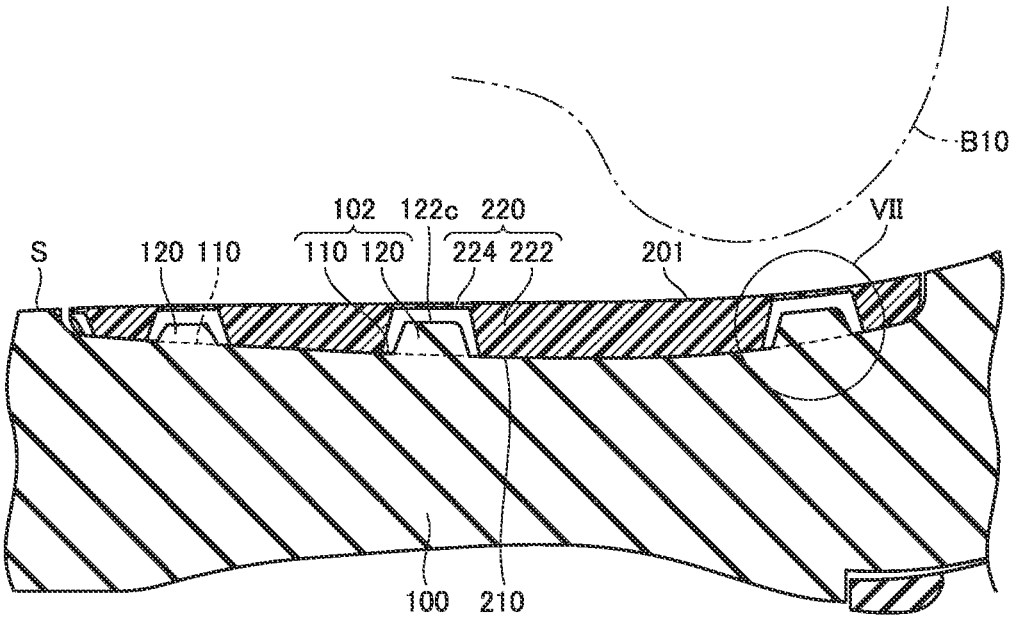
FIG. 6 is an enlarged view illustrating a range indicated by a solid line VI in FIG. 3.

The reference surface 110 is formed at the position recessed from the surface S toward the outer sole 12. As illustrated in FIGS. 3, 4, 6, and the like, the reference surface 110 is formed in a slightly-curved shape so as to protrude toward the outer sole 12 side (lower side). However, the reference surface 110 may be formed flat.

The protrusion 120 has a shape protruding from the reference surface 110 toward the side (upper side) opposite to the side where the outer sole 12 is located. The protrusion 120 includes a plurality of protruding elements 121 having shapes protruding from portions of the reference surface 110 separated from each other. In the embodiment, each protruding element 121 is formed in a hexagonal columnar shape. However, each protruding element 121 may be formed in a cylindrical shape or a triangular prism shape. Each protruding element 121 is preferably formed in a polygonal shape in planar view, and particularly preferably formed in a polygonal shape greater than or equal to a pentagon.

Figure 7:
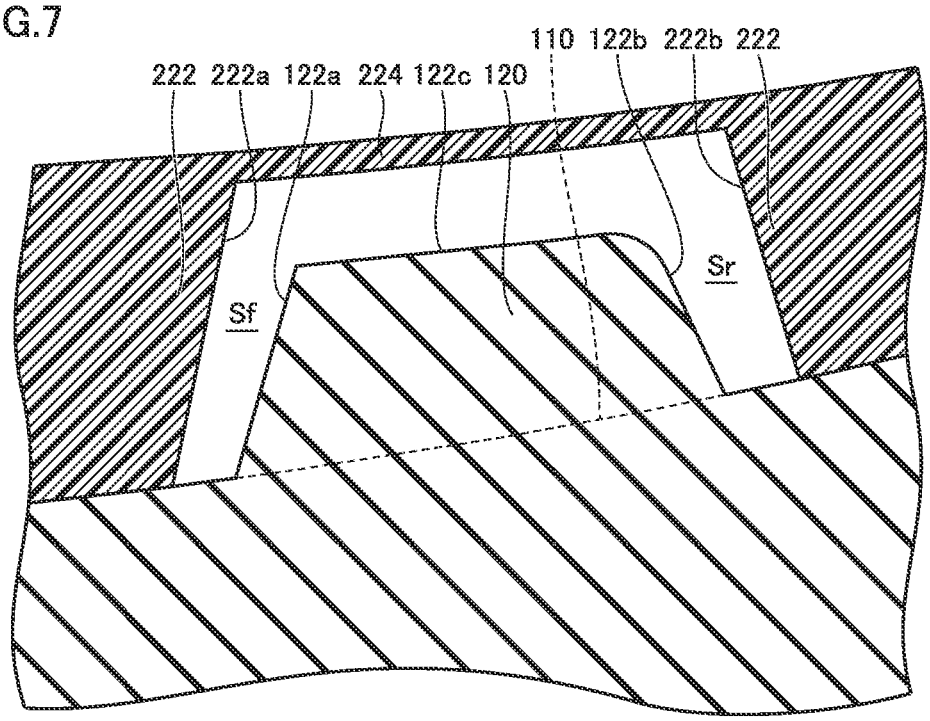
FIG. 7 is an enlarged view illustrating a range indicated by a solid line VII in FIG. 6.

As illustrated in FIGS. 5, 7, and the like, each protruding element 121 has a front side surface 122*a*, a rear side surface 122*b*, and a top surface 122*c*. The front side surface 122*a* is formed at the front portion in the foot length direction. The rear side surface 122*b* is formed at the rear portion in the foot length direction. The top surface 122*c* is constituted of the surface of the protruding element 121. The top surface 122*c* is formed flat. The top surface 122*c* is formed at the position closer to the reference surface 110 than the surface S. As illustrated in FIG. 7, a corner between the rear side surface 122*b* and the top surface 122*c* is formed in a curved shape.

The buffer member 200 is a member absorbing the impact mainly applied to the heel at the time of grounding. The buffer member 200 is formed separately from the midsole body 100. The buffer member 200 is mounted on the mounting portion 102 in a non-adhesive state. The buffer member 200 is made of a material having hardness lower than that of the material constituting the midsole body 100. The hardness of the buffer member 200 is preferably about HC 15 to HC 35 in Asker C hardness, and more preferably about HC 20.

The material constituting the buffer member 200 may be basically any material as long as the material is a material rich in elastic force, but may be a resin foam such as a polyolefin resin, a polyurethane resin, a nylon resin, or an ethylene-vinyl acetate copolymer that is the same as the material constituting the midsole body 100. In this case, the hardness can be made lower than that of the midsole body 100 by adjusting the foaming ratio of the material constituting the buffer member 200.

The buffer member 200 may be formed of a polymer composition. In this case, olefin-based polymers such as olefin-based elastomers and olefin-based resins can be cited as an example of the polymer contained in the polymer composition. Polyethylene (for example, linear low density polyethylene (LLDPE), high density polyethylene (HDPE), and the like), polypropylene, an ethylene-propylene copolymer, a propylene-1 hexene copolymer, a propylene-4 methyl 1 pentene copolymer, a propylene-1 butene copolymer, an ethylene-1 hexene copolymer, an ethylene-4 methyl-pentene copolymer, an ethylene-1 butene copolymer, a 1-butene-1 hexene copolymer, a 1-butene-4 methyl-pentene, an ethylene-methacrylic acid copolymer, an ethylene-methyl methacrylate copolymer, an ethylene-ethyl methacrylate copolymer, an ethylene-ethyl methacrylate copolymer, an ethylene-butyl acrylate copolymer, a propylene-methacrylic acid copolymer, a propylene-methyl methacrylate copolymer, and a propylene-ethyl methacrylate copolymer, Examples thereof include polyolefins such as a propylene-butyl methacrylate copolymer, a propylene-methyl acrylate copolymer, a propylene-ethyl acrylate copolymer, a propylene-butyl acrylate copolymer, an ethylene-vinyl acetate copolymer (EVA), and a propylene-vinyl acetate copolymer can be cited as an example of the olefin-based polymer.

For example, the polymer may be an amide-based polymer such as an amide-based elastomer or an amide-based resin. Polyamide 6, polyamide 11, polyamide 12, polyamide 66, and polyamide 610 can be cited as an example of the amide-based polymer.

For example, the polymer may be an ester-based polymer such as an ester-based elastomer or an ester-based resin. Polyethylene terephthalate and polybutylene terephthalate can be cited as an example of the ester-based polymer.

For example, the polymer may be a urethane-based polymer such as a urethane-based elastomer or a urethane-based resin. Polyester-based polyurethane and polyether-based polyurethane can be cited as an example of the urethane-based polymer.

For example, the polymer may be a styrene-based polymer such as a styrene-based elastomer or a styrene-based resin. A styrene-ethylene-butylene copolymer (SEB), a styrene-butadiene-styrene copolymer (SBS), a hydrogenated product of SBS (styrene-ethylene-butylene-styrene copolymer (SEBS)), a styrene-isoprene-styrene copolymer (SIS), a hydrogenated product of SIS (styrene-ethylene-propylene-styrene copolymer (SEPS)), a styrene-isobutylene-styrene copolymer (SIBS), styrene-butadiene-styrene-butadiene (SBSB), and styrene-butadiene-styrene-butadiene-styrene (SBSBS) can be cited as an example of the styrene elastomer. Polystyrene, acrylonitrile styrene resin (AS), and acrylonitrile butadiene styrene resin (ABS) can be cited as an example of the styrene-based resin.

For example, the polymer may be an acrylic polymer such as polymethyl methacrylate, a urethane-based acrylic polymer, a polyester-based acrylic polymer, a polyether-based acrylic polymer, a polycarbonate-based acrylic polymer, an epoxy-based acrylic polymer, a conjugated diene polymerization-based acrylic polymer and hydrogenated products thereof, a urethane-based methacrylic polymer, a polyester-based methacrylic polymer, a polyether-based methacrylic polymer, a polycarbonate-based methacrylic polymer, an epoxy-based methacrylic polymer, a conjugated diene polymerization-based methacrylic polymer and hydrogenated products thereof, a polyvinyl chloride-based resin, a silicone-based elastomer, a butadiene rubber (BR), an isoprene rubber (IR), a chloroprene (CR), a natural rubber (NR), a styrene butadiene rubber (SBR), an acrylonitrile butadiene rubber (NBR), and a butyl rubber (IIR).

Figure 8:
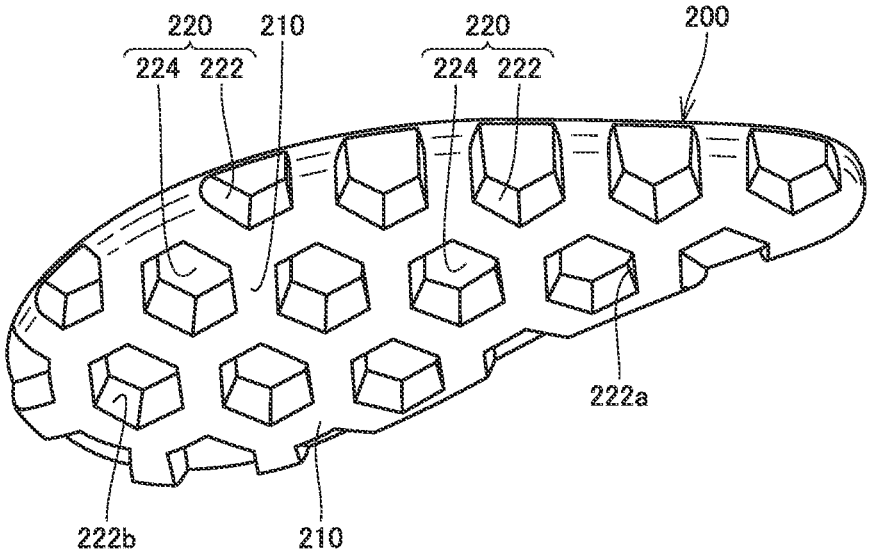
FIG. 8 is a perspective view of a buffer member.

As illustrated in FIG. 8 and the like, the buffer member 200 has a recess 220. The recess 220 has a shape capable of receiving the protrusion 120, in the embodiment, the recess 220 includes a plurality of recessed elements 221 each of which is capable of receiving the protruding element 121. Each recessed element 221 includes a surrounding wall 222 and a top wall 224.

The surrounding wall 222 has a shape that entirely surrounds a periphery of the protruding element 121. The surrounding wall 222 preferably surrounds the entire periphery of the protruding element 121, but may have a configuration in which a part in the circumferential direction is interrupted. An inner peripheral surface of the section of the surrounding wall 222 in a plane orthogonal to the thickness direction of the sole 10 has the hexagonal shape. A lower surface 210 of the surrounding wall 222 is opposite to the reference surface 110. The lower surface 210 may be in contact with the reference surface 110, or be separated from the reference surface 110. In the embodiment, the lower surface 210 of the surrounding wall 222 is in contact with the reference surface 110. The thickness of the surrounding wall 222 surrounding one protruding element 121 of the plurality of protruding elements 121 is larger than the thickness of the one protruding element 121 over the entire region in the circumferential direction of the surrounding wall 222. The thickness of the protruding element 121 means a length between the reference surface 110 and the top surface 122*c* of the protruding element 121. As illustrated in FIG. 8, the surrounding wall 222 of each recessed element 221 is connected to the surrounding wall 222 in the recessed element 221 adjacent to the recessed element 221.

As illustrated in FIG. 6, the buffer member 200 includes a support point 201 that supports the calcaneus B10. The thickness of the buffer member 200 is maximum at the support point 201. The thickness of the surrounding wall 222 in the plurality of recessed elements 221 gradually decreases from the support point 201 toward the front in the foot length direction (the left side in FIG. 6)

As illustrated in FIGS. 7 and 8, the surrounding wall 222 has a front opposing surface 222*a* and a rear opposing surface 222*b*. The front opposing surface 222*a* is opposite to the front side surface 122*a* in the foot length direction. The rear opposing surface 222*b* is opposite to the rear side surface 122*b* in the foot length direction. As illustrated in FIG. 7, a gap Sr between the rear side surface 122*b* and the rear opposing surface 222*b* in the foot length direction is larger than a gap Sf between the front side surface 122*a* and the front opposing surface 222*a* in the foot length direction.

The top wall 224 has a shape that closes an upper portion of the surrounding wall 222. As illustrated in FIGS. 4, 6, and 7, the top wall 224 is opposite to the top surface 122*c* of the protruding element 121 while a gap interposed therebetween. The thickness of the top wall 224 is smaller than the thickness of the surrounding wall 222. The surface of the top wall 224 is formed to be flush with the surface of the surrounding wall 222.

As described above, in the sole 10 of the embodiment, because the recess 220 includes the surrounding wall 222 having a shape surrounding the entire periphery of the protrusion 120, the excessive shear deformation of the buffer member 200 can be prevented with respect to the midsole body 100 at the time of grounding. Accordingly, both the buffer property and the high stability are achieved.

Hereinafter, modifications of the above embodiment will be described.

First Modification

In the above embodiment, an example in which the protrusion 120 has the plurality of protruding elements 121 and the recess 220 has the plurality of recessed elements 221 has been illustrated. However, the protrusion 120 may be constituted of the single protruding element 121 and the recess 220 may be constituted of the single recessed element 221. In the above embodiment, an example in which the reference surface 110 and the protrusion 120 are provided on the mounting portion 102 of the midsole body 100 while the recess 220 is provided on the buffer member 200 has been illustrated. However, the recess may be provided on the mounting portion 102 and the reference surface and the protrusion may be provided on the buffer member 200. In this way, the deformation of the mounting portion 102 of the midsole body 100 at the time of grounding is further prevented, so that the higher stability can be obtained.

Second Modification

Figure 9:
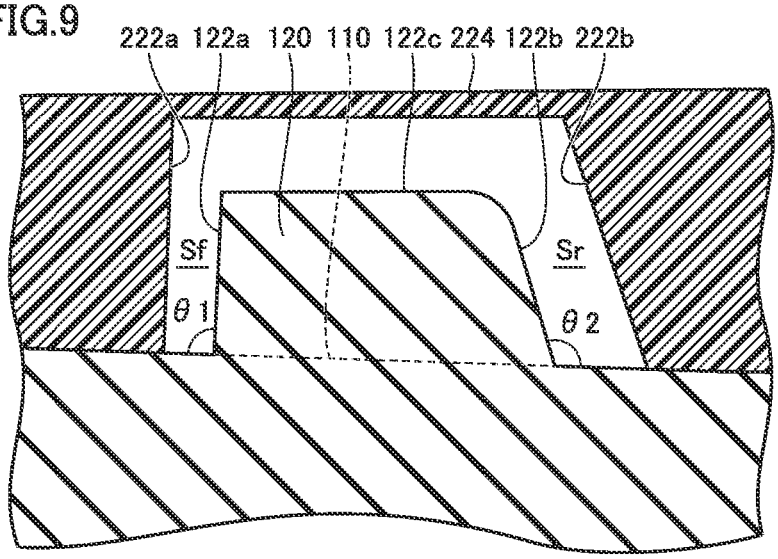
FIG. 9 is a sectional view illustrating a modification of a protrusion and a recess.

As illustrated in FIG. 9, an angle θ2 formed by the reference surface 110 and the rear side surface 122*b* may be larger than an angle θ1 formed by the reference surface 110 and the front side surface 122*a*. In the example of FIG. 9, the angle θ1 is set to 90 degrees. In this way, an effect that the rear side surface 122*b* that dominantly acts on the deformation at the time of grounding is easily deformed while the front side surface 122*a* that dominantly acts on the taking-off toward the separated ground easily contributes to the catching of the buffer member 200 can be obtained.

Third Modification

Figure 10:
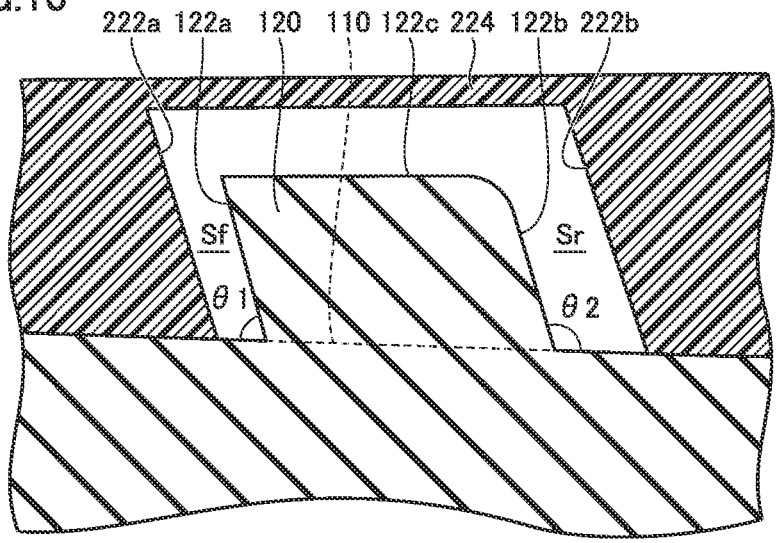
FIG. 10 is a sectional view illustrating a modification of the protrusion and the recess.

As illustrated in FIG. 10, the angle θ1 formed by the reference surface 110 and the front side surface 122*a* may be formed at an acute angle, and the angle θ2 formed by the reference surface 110 and the rear side surface 122*b* may be formed at an obtuse angle. In this way, the effect of catching the front side surface 122*a* is further enhanced as compared with the second modification.

Fourth Modification

Figure 11:
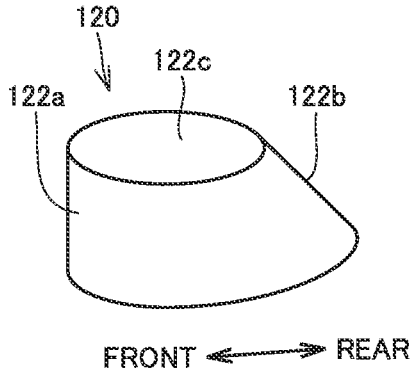
FIG. 11 is a sectional view illustrating a modification of the protrusion.

As illustrated in FIG. 11, the section of the protruding element 121 on the plane orthogonal to the thickness direction of the sole 10 may be formed in a circular or elliptical shape. Also in this example, the angle θ2 formed by the reference surface 110 and the rear side surface 122*b* may be larger than the angle θ1 formed by the reference surface 110 and the front side surface 122*a*. Also in this example, the same effects as those of the second modification can be obtained.

Fifth Modification

Figure 12:
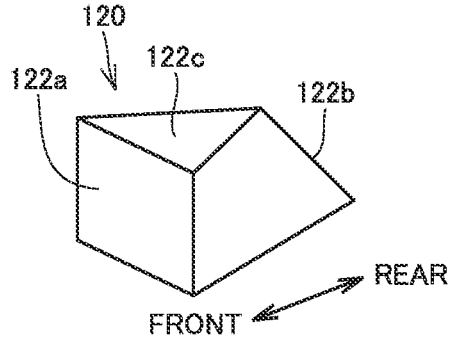
FIG. 12 is a sectional view illustrating a modification of the protrusion.

As illustrated in FIG. 12, the section of the protruding element 121 on the plane orthogonal to the thickness direction of the sole 10 may be formed in a triangular shape. In this case, the front side surface 122*a* is preferably orthogonal to the foot length direction. Also in this example, the angle θ2 formed by the reference surface 110 and the rear side surface 122*b* may be larger than the angle θ1 formed by the reference surface 110 and the front side surface 122*a*. Also in this example, the same effects as those of the second modification can be obtained.

Sixth Modification

Figure 13:
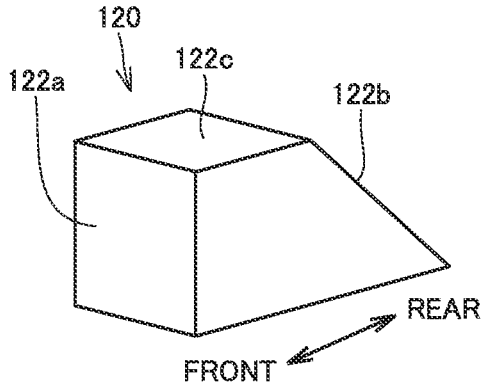
FIG. 13 is a sectional view illustrating a modification of the protrusion.

As illustrated in FIG. 13, the section of the protruding element 121 on the plane orthogonal to the thickness direction of the sole 10 may be formed in a quadrangular shape. In this case, the front side surface 122*a* is preferably orthogonal to the foot length direction. Also in this example, the angle θ2 formed by the reference surface 110 and the rear side surface 122*b* may be larger than the angle θ1 funned by the reference surface 110 and the front side surface 122*a*. Also in this example, the same effects as those of the second modification can be obtained.

Seventh Modification

Figure 14:
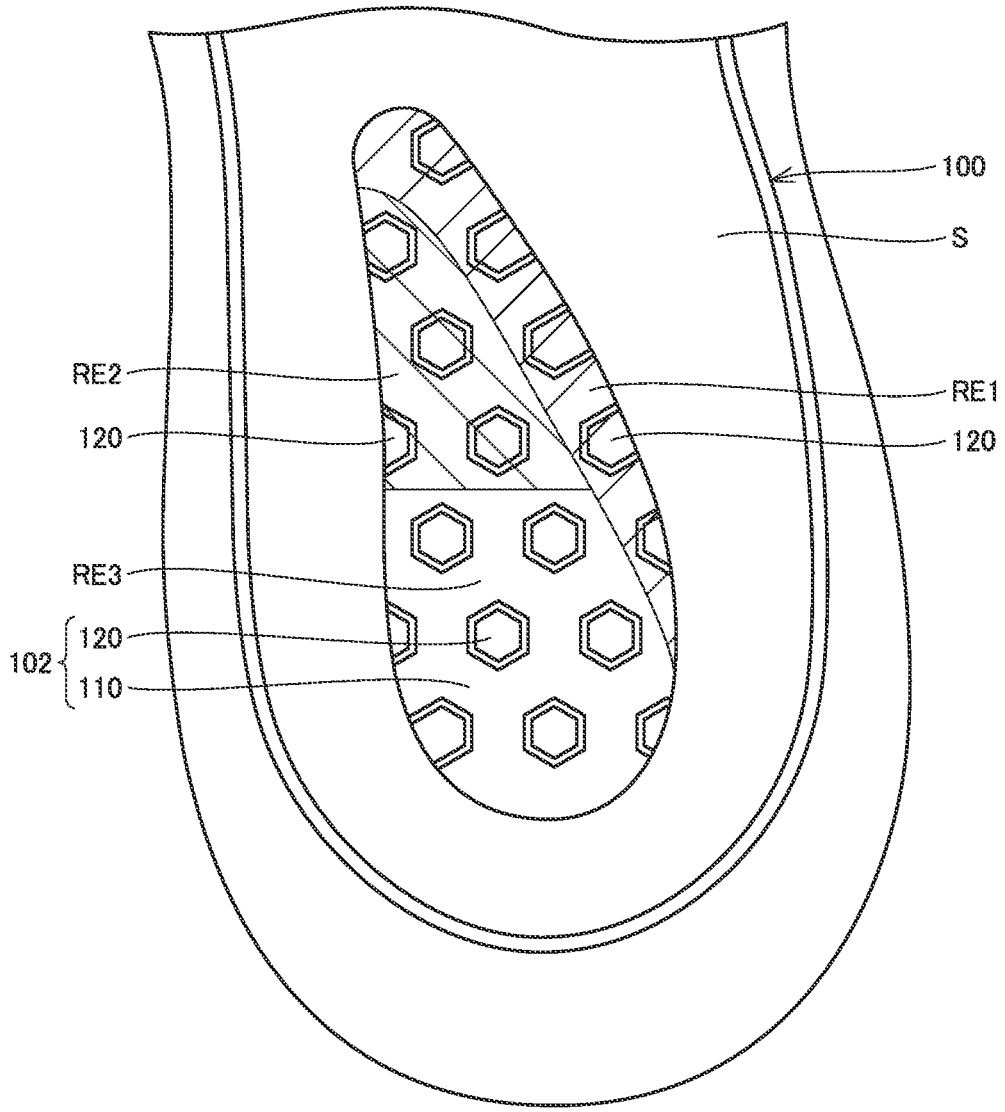
FIG. 14 is a plan view illustrating a modification of a relationship between a region and the protrusion in the mounting portion.

As illustrated in FIG. 14, the mounting portion 102 may be divided into a first region RE1, a second region RE2, and a third region RE3. In FIG. 14, the first region RE1 and the second region RE2 are hatched.

The first region RE1 means the region located on the side of the midfoot region R2 and the medial foot side of the mounting portion 102. In this example, five protruding elements 121 are arranged in the first region RE1. The second region RE2 means the region located on the side of the midfoot region R2 and the lateral foot side of the mounting portion 102. In this example, four protruding elements 121 are arranged in the second region RE2. The third region RE3 means the region other than the first region RE1 and the second region RE2 in the mounting portion 102. In this example, eight protruding elements 121 are arranged in the third region RE3.

The angle θ2 formed by the reference surface 110 and the rear side surface 122*b* is formed so as to increase in order of the protruding element 121 arranged in the first region RE1, the protruding element 121 arranged in the second region RE2, and the protruding element 121 arranged in the third region RE3.

In this aspect, the shear deformation amount of each surrounding wall 222 in the first region RE1 and the second region RE2 is smaller than the shear deformation amount of each surrounding wall 222 in the third region RE3, so that the stability at the time of grounding is improved. Furthermore, the shear deformation amount of each surrounding wall 222 in the first region RE1 is smaller than the shear deformation amount of each surrounding wall 222 in the second region RE2, so that the generation of pronation at the time of grounding is prevented.

Eighth Modification

Figure 15:
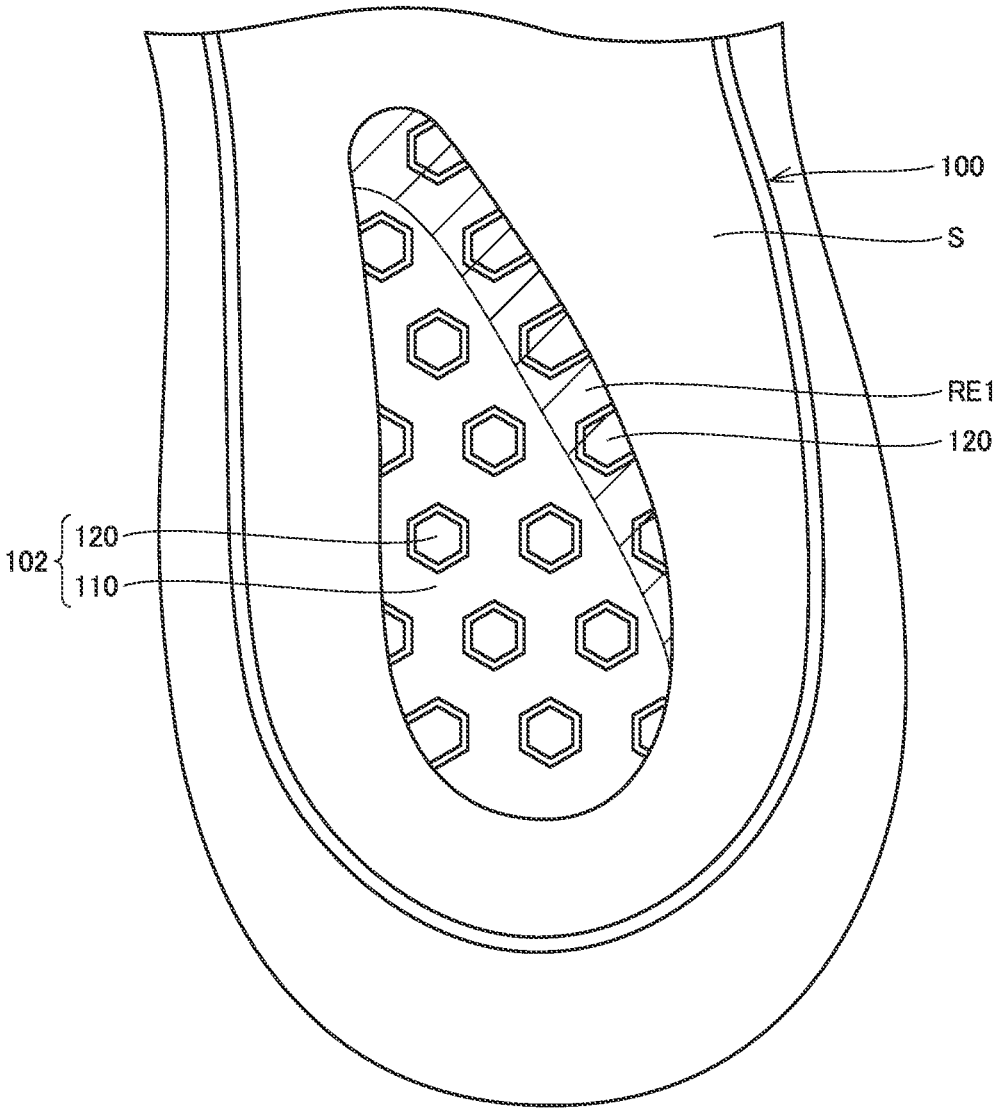
FIG. 15 is a plan view illustrating a modification of the relationship between the region and the protrusion in the mounting portion.

As illustrated in FIG. 15, the mounting portion 102 may be divided into the first region RE1 and other regions. The range of the first region RE1 and the number of the protruding elements 121 arranged in the range of the first region RE1 are the same as those in the seventh modification. In FIG. 15, the first region RE1 is hatched.

The height of each of the protruding elements 121 arranged in the first region RE1 is formed to be larger than the height of each of the protruding elements 121 arranged in other regions. As a result, the gap between the protruding element 121 and the recessed element 221 in the first region RE1 is smaller than the gap between the protruding element 121 and the recessed element 221 in other regions. The height of each of the protruding elements 121 arranged in the first region RE1 may gradually increase toward the medial foot side in the foot width direction.

In this aspect, the shear deformation amount of each surrounding wall 222 in the first region RE1 is smaller than the shear deformation amount of each surrounding wall 222 in other regions, so that the generation of the pronation at the time of grounding is prevented.

Ninth Modification

Figure 16:
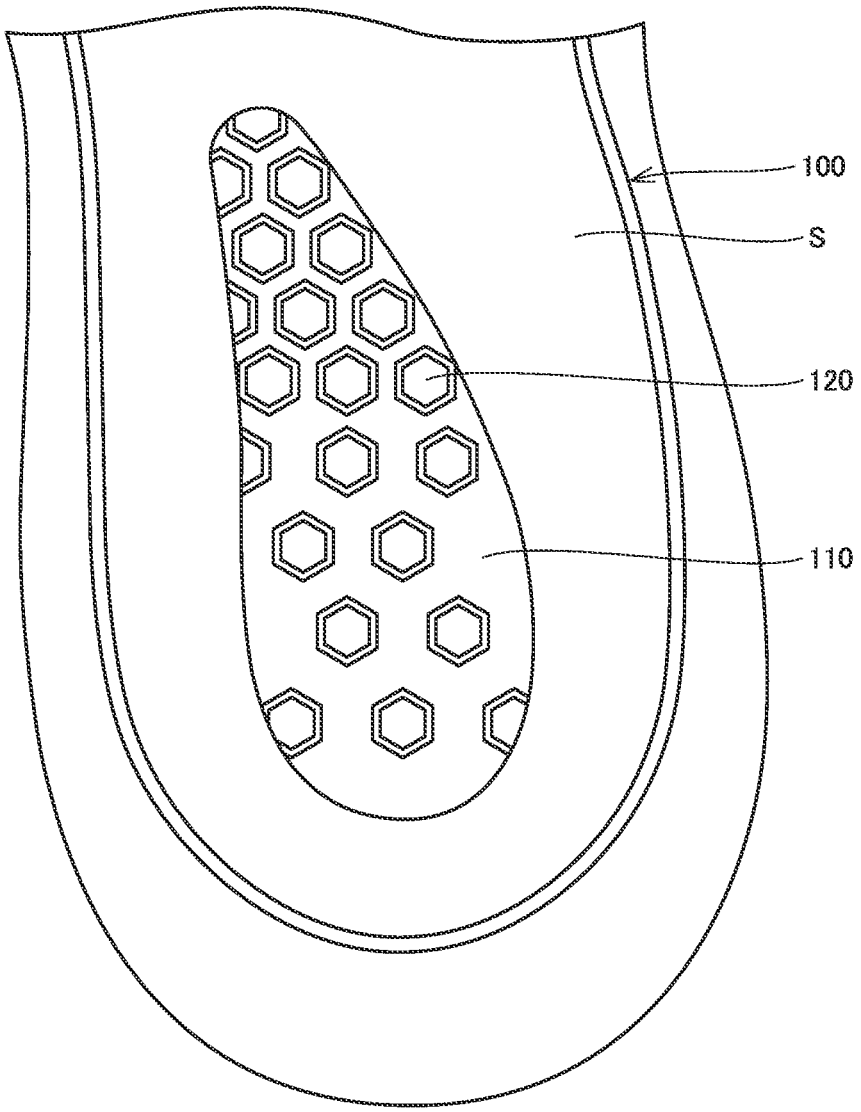
FIG. 16 is a plan view illustrating a modification of the relationship between the region and the protrusion in the mounting portion.

As illustrated in FIG. 16, the density of the protruding elements 121 in the front region of the mounting portion 102 may be higher than that in the rear region.

In this aspect, the stability at the time of grounding is improved, and the weight is smoothly moved from grounding to taking-off.

Tenth Modification

Figure 17:
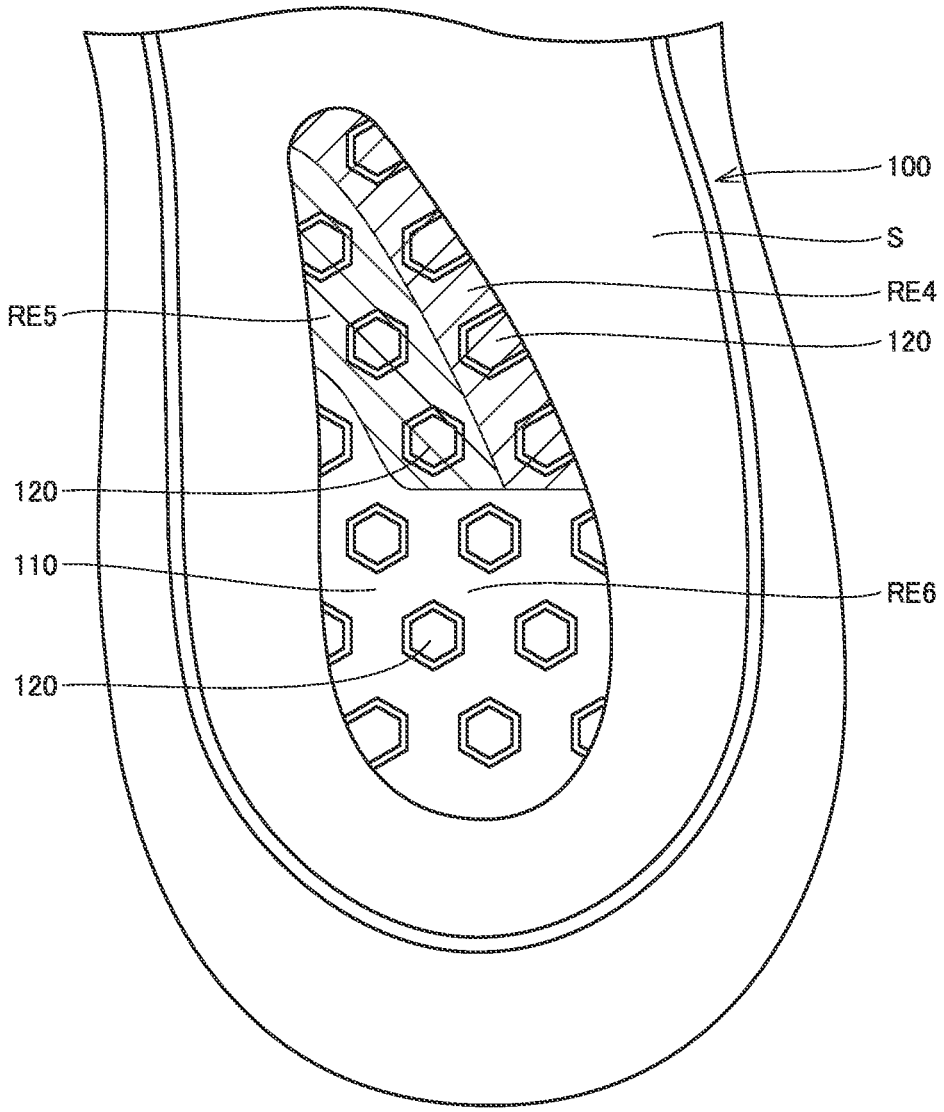
FIG. 17 is a plan view illustrating a modification of the relationship between the region and the protrusion in the mounting portion.

As illustrated in FIG. 17, the mounting portion 102 may be divided into a fourth region RE4, a fifth region RE5, and a sixth region RE6. In FIG. 17, the fourth region RE4 and the fifth region RE5 are hatched.

The fourth region RE4 means the region located on the side of the midfoot region R2 and on the medial foot side of the mounting portion 102. In this example, four protruding elements 121 are arranged in the fourth region RE4. The fifth region RE5 means a region outside the fourth region RE4 in the foot width direction. In this example, three protruding elements 121 are arranged in the fifth region RE5. The sixth region RE6 means the region other than the fourth region RE4 and the fifth region RE5 in the mounting portion 102. In this example, ten protruding elements 121 are arranged in the sixth region RE6

The outer shape of the protruding element 121 is formed so as to increase in order of the sixth region RE6, the fifth region RE5, and the fourth region RE4.

In this aspect, the shear deformation amount of each surrounding wall 222 in the fourth region RE4 and the fifth region RE5 is smaller than the shear deformation amount of each surrounding wall 222 in the sixth region RE6, so that the stability at the time of grounding is improved. Furthermore, the shear deformation amount of each surrounding wall 222 in the fourth region RE4 is smaller than the shear deformation amount of each surrounding wall 222 in the fifth region RE5, so that the generation of the pronation at the time of grounding is prevented.

Eleventh Modification

Figure 18:
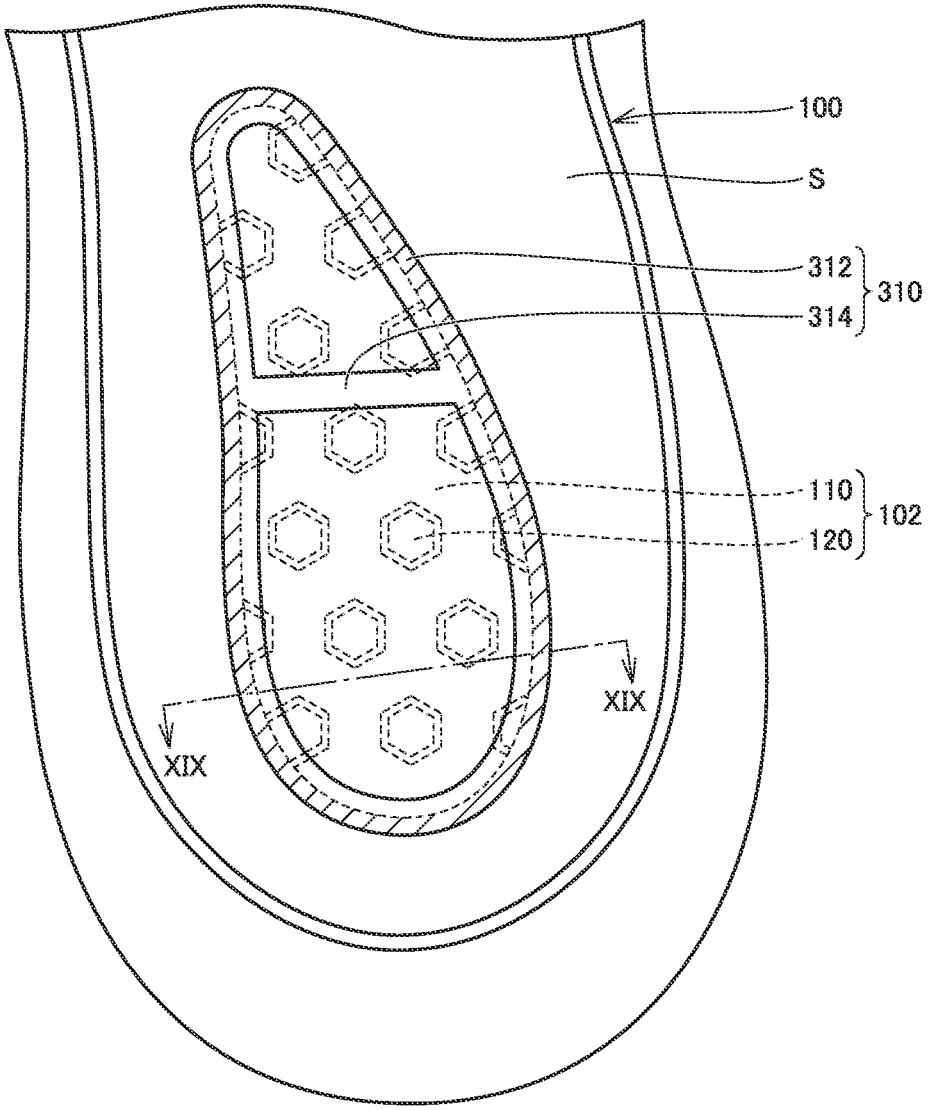
FIG. 18 is a plan view illustrating a modification of the midsole.
Figure 19:
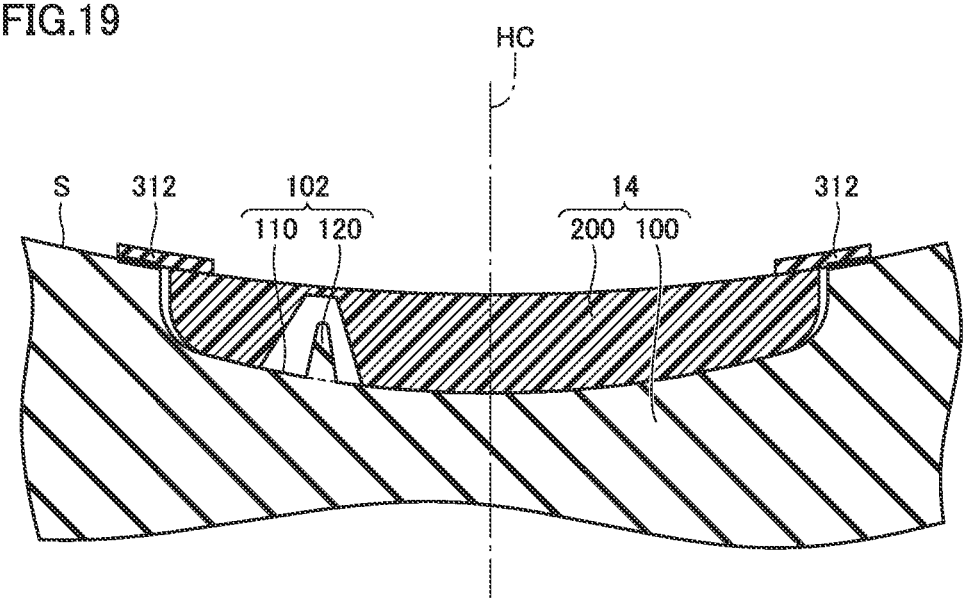
FIG. 19 is a sectional view taken along line XIX-XIX in FIG. 18.

As illustrated in FIGS. 18 and 19, the sole 10 may further include a holding member 310 that holds the buffer member 200 in the state of being mounted on the mounting portion 102. The holding member 310 is made of a nonwoven fabric. The holding member 310 is bonded to the surface S of the midsole body 100. The holding member 310 may include an annular portion 312 and a bridging portion 314.

The annular portion 312 has a shape extending over a boundary portion between the surface S of the midsole body 100 and the surface of the buffer member 200. As illustrated in FIG. 18, the annular portion 312 is formed in an annular shape extending over the entire boundary portion. As indicated by a thick line in FIG. 19, only a portion outside the boundary portion in the annular portion 312 is bonded to the surface S of the midsole body 100. Thus, the positions of the buffer member 200 and the midsole body 100 are appropriately fixed, and degradation of the buffer property due to curing of the adhesive can be prevented at an inner portion of the boundary portion.

The bridging portion 314 is connected to the annular portion 312. The bridging portion 314 has a shape extending in the foot width direction. The bridging portion 314 is not bonded to the buffer member 200. Thus, a decrease in buffer property due to curing of the adhesive can be prevented at this portion. The bridging portion 314 may be omitted.

Twelfth Modification

Figure 20:
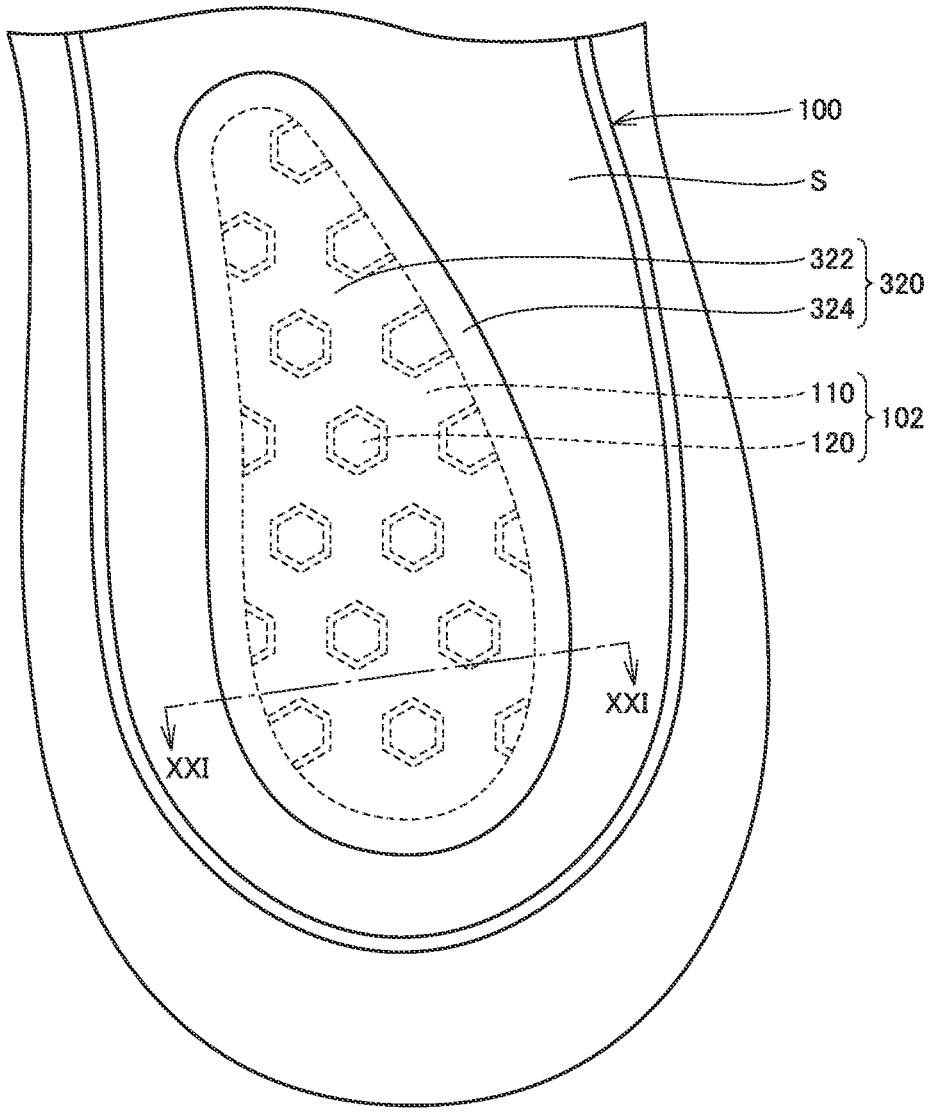
FIG. 20 is a plan view illustrating a modification of the midsole.
Figure 21:
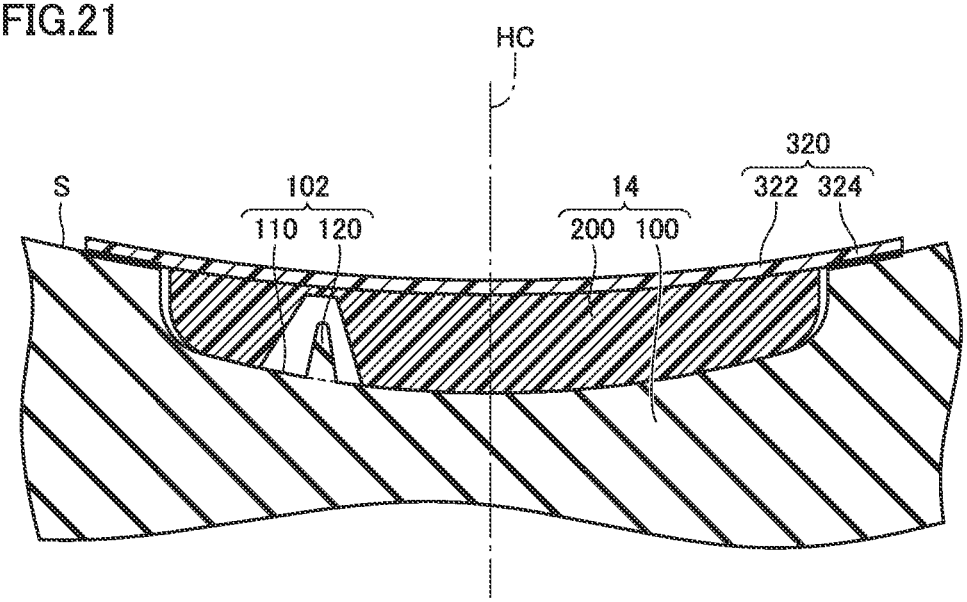
FIG. 21 is a sectional view taken along line XXI-XXI in FIG. 20.

As illustrated in FIGS. 20 and 21, the sole 10 may further include a holding member 320 that holds the buffer member 200 in the state of being mounted to the mounting portion 102. The holding member 320 is made of a resin film (urethane film or the like). The holding member 320 includes a covering portion 322 and an overhang 324.

The covering portion 322 covers the surface of the buffer member 200. As illustrated in FIG. 20, the covering portion 322 may cover the entire surface of the buffer member 200, or cover only a part of the surface of the buffer member 200.

As illustrated in FIG. 20, the overhang 324 overhangs to the outside of the buffer member 200 in planar view. The overhang 324 has a shape connected in an annular shape outside the covering portion 322. As indicated by a thick line in FIG. 21, the overhang 324 is bonded to the surface S of the midsole body 100. Thus, the positions of the buffer member 200 and the midsole body 100 are appropriately fixed.

It is understood by those skilled in the art that the plurality of embodiments described above are specific examples of the following aspects.

A sole according to one aspect of the present disclosure is a sole constituting a part of a shoe, the sole including: a midsole body having a surface; and a buffer member made of a material having hardness lower than that of a material constituting the midsole body. The midsole body includes: a forefoot region that overlaps with a forefoot portion of a wearer of the shoe in a thickness direction of the sole; a midfoot region that overlaps with a midfoot portion of the wearer of the shoe in the thickness direction of the sole; and a rearfoot region that overlaps with a rearfoot portion of the wearer of the shoe in a thickness direction of the sole, a mounting portion that mounts the buffer member is formed on the surface of the rearfoot region, the buffer member is mounted on the mounting portion in a non-adhesive state, one of the mounting portion and the buffer member includes: a reference surface; and a protrusion that protrudes from the reference surface toward the other of the mounting portion and the buffer member, the other of the mounting portion and the buffer member includes a recess that is capable of receiving the protrusion, and the recess includes a surrounding wall having a shape that entirely surrounds a periphery of the protrusion.

In this sole, the recess includes the surrounding wall having the shape surrounding the entire periphery of the protrusion, so that the excessive shear deformation of the buffer member can prevented with respect to the midsole body at the time of grounding. Accordingly, both the buffer property and the high stability are achieved.

The midsole body may include the reference surface and the protrusion, and the buffer member may include the recess. In this case, preferably the protrusion includes a plurality of protruding elements having a shape protruding from portions separated from each other on the reference surface, and the recess includes a plurality of recessed elements each of which can receive each protruding element in the plurality of protruding elements.

In this aspect, a sectional area of the surrounding wall made of a material having relatively low hardness is larger than a sectional area of the protruding element made of a material having relatively high hardness, so that the excessive shear deformation of the buffer member is effectively prevented.

A space is preferably formed between each of the protruding elements and each of the recessed elements.

In this way, the deformation allowance of the buffer member is secured, so that the buffer property is further enhanced.

Each of the protruding elements includes: a front side surface formed at a front portion in a foot length direction; and a rear side surface formed at a rear portion in the foot length direction, and each of the recessed elements includes: a front opposing surface that is opposed to the front side surface in the foot length direction; and a rear opposing surface that is opposite to the rear side surface in the foot length direction. In this case, a gap between the rear side surface and the rear opposing surface in the foot length direction is preferably larger than a gap between the front side surface and the front opposing surface in the foot length direction.

In this aspect, because the gap between the rear side surface and the rear opposing surface is large, a forward deformation margin of the buffer member at the time of grounding is secured, so that a buffer effect is obtained. On the other hand, because the gap between the front side surface and the front opposing surface is small, the shearing deformation of the buffer member at take-off is prevented, so that a decrease in propulsive force is prevented.

Preferably an angle formed by the reference surface and the rear side surface is larger than an angle formed by the reference surface and the front side surface.

In this aspect, an effect that the rear side surface that dominantly acts on the deformation at the time of grounding is easily deformed while the front side surface that dominantly acts on the taking-off toward the separated ground easily contributes to the catching of the buffer member can be obtained.

A thickness of the surrounding wall surrounding one protruding element of the plurality of protruding elements is preferably larger than a thickness of the one protruding element.

In this aspect, the excessive shear deformation of the buffer member at the time of grounding is more reliably prevented.

Preferably a thickness of the surrounding wall in the plurality of recessed elements decreases toward front in a foot length direction.

In this way, the thickness of the surrounding wall decreases toward the midfoot portion having a relatively small pressure acting from the grounding to the taking-off, so that the weight movement from the grounding to the taking-off becomes smooth.

Preferably the surrounding wall of each of the recessed elements is connected to the surrounding wall of a recessed element adjacent to the recessed element.

In this way, the excessive shear deformation of the buffer member at the time of grounding is more reliably prevented.

Each of the recessed elements may further include a top wall that closes an upper portion of the surrounding wall. In this case, the thickness of the top wall is preferably smaller than the thickness of the surrounding wall.

In this aspect, compared to the case where the thickness of the top wall is larger than the thickness of the surrounding wall, the shearing deformation of the surrounding wall is superior to the compressive deformation of the top wall at the time of grounding, so that the buffer property and the stability at the time of grounding are improved.

The sole may further include a holding member that holds the buffer member in a state of being mounted on the mounting portion. In this case, preferably the holding member has a shape straddling a boundary portion between the surface of the midsole body and the surface of the buffer member and is bonded to the surface of the midsole body.

In this aspect, the buffer member is held in the state of being mounted on the mounting portion of the midsole body by the holding member, so that the buffer member is prevented from falling off from the midsole body when the upper is assembled to the sole.

A shoe according to one aspect of the present disclosure includes the sole and an upper that is connected to the sole and located above the sole.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A sole for use in a shoe, the sole comprising:

a midsole body having a surface; and a buffer member including a material having a hardness lower than a hardness of a material of the midsole body, wherein the midsole body includes:

a forefoot region configured to overlap with a forefoot portion of a wearer of the shoe in a thickness direction of the sole;

a midfoot region configured to overlap with a midfoot portion of the wearer of the shoe in the thickness direction of the sole; and a rearfoot region configured to overlap with a rearfoot portion of the wearer of the shoe in the thickness direction of the sole, a mounting portion configured to mount with the buffer member, the mounting portion is disposed on the surface of the midsole body in the rearfoot region, the buffer member is mounted on the mounting portion in a non-adhesive state, the mounting portion includes a reference surface and a plurality of protrusions that protrude from the reference surface toward the buffer member, the plurality of protrusions have shapes protruding from portions separated from each other on the reference surface, the buffer member includes a plurality of recesses, each of the plurality of recesses is configured to receive a respective protrusion of the plurality of protrusions, and a recess of the plurality of recesses is defined by a surrounding wall having a shape that entirely surrounds a periphery of a base of a protrusion of the plurality of protrusions at a level of the reference surface and is spaced away from the entire periphery of the base of the protrusion of the plurality of protrusions.

2. The sole according to claim 1, wherein a space is between each of the plurality of protrusions and each of the plurality of recesses.

3. The sole according to claim 2, wherein each of the plurality of protrusions includes:

a front side surface at a front portion in a foot length direction; and a rear side surface at a rear portion in the foot length direction, each of the plurality of recesses includes:

a front opposing surface that is opposed to the front side surface in the foot length direction; and a rear opposing surface that is opposite to the rear side surface in the foot length direction, and a gap between the rear side surface and the rear opposing surface in the foot length direction is larger than a gap between the front side surface and the front opposing surface in the foot length direction.

4. The sole according to claim 3, wherein an angle defined by the reference surface and the rear side surface is larger than an angle defined by the reference surface and the front side surface.

5. The sole according to claim 1, wherein a thickness of the surrounding wall surrounding the protrusion of the plurality of protrusions is larger than a thickness of the protrusion of the plurality of protrusions.

6. The sole according to claim 1, wherein a thickness of the surrounding wall decreases toward a front in a foot length direction.

7. The sole according to claim 1, wherein the surrounding wall is connected to an adjacent surrounding wall of an adjacent recess of the plurality of recesses.

8. The sole according to claim 1, wherein the recess of the plurality of recesses further includes a top wall that closes an upper portion of the surrounding wall, and a thickness of the top wall is smaller than a thickness of the surrounding wall.

9. The sole according to claim 1, further comprising:

a holding member that holds the buffer member in a state of being mounted on the mounting portion, wherein the holding member has a shape straddling a boundary portion between the surface of the midsole body and the surface of the buffer member and is bonded to the surface of the midsole body.

10. A shoe comprising:

the sole according to claim 1; and an upper that is connected to the sole and located above the sole.

* * * * *